US007299549B2

(12) United States Patent
Montena

(10) Patent No.: US 7,299,549 B2
(45) Date of Patent: Nov. 27, 2007

(54) SLOTTED CABLE GUIDE

(76) Inventor: Noah Montena, 124 Buckingham Ave., Syracuse, NY (US) 13210

( * ) Notice: Subject to any disclaimer, the term of this patent is extended or adjusted under 35 U.S.C. 154(b) by 395 days.

(21) Appl. No.: 11/008,823

(22) Filed: Dec. 10, 2004

(65) Prior Publication Data

US 2006/0123625 A1 Jun. 15, 2006

(51) Int. Cl.
*H01R 43/00* (2006.01)
*H01R 9/05* (2006.01)

(52) U.S. Cl. ..... 29/857; 29/745; 29/828; 29/868; 29/755; 439/578

(58) Field of Classification Search ..... 29/857, 29/828, 745, 746, 754, 755, 761, 868; 439/578, 439/583, 581, 584, 439, 585; 174/88 C, 174/75 C, 89, 71 C
See application file for complete search history.

(56) References Cited

U.S. PATENT DOCUMENTS 2,973,219 A * 2/1961 Zalk ..... 294/92
5,342,218 A 8/1994 McMills et al.
5,470,257 A 11/1995 Szegda
5,542,861 A * 8/1996 Anhalt et al. ..... 439/578
5,620,339 A * 4/1997 Gray et al. ..... 439/578
6,159,046 A 12/2000 Wong
6,179,656 B1 1/2001 Wong
6,210,222 B1 * 4/2001 Langham et al. ..... 439/583
6,352,448 B1 3/2002 Holliday et al.
6,517,379 B2 * 2/2003 Leve ..... 439/578

* cited by examiner

*Primary Examiner*—A. Dexter Tugbang
*Assistant Examiner*—Tai Van Nguyen
(74) *Attorney, Agent, or Firm*—Marjama Muldoon Blasiak Sullivan, LLP

(57) ABSTRACT

A guide for inserting the prepared end of a coaxial cable into the cylindrical post of an end connector of a coaxial cable. The guide is an elongated member that is fabricated of a resilient material having a plurality flat sides that come together at equal angles to form a number of corners. The bisectors of the corner angles all cross at the central axis of the guide with the length of each bisector between the center axis and the corner being substantially equal to or greater than the inside radius of the post. A central slot passes axially through the guide and a slit passes radially through one side wall of the guide to form an entrance that opens into the slot.

22 Claims, 5 Drawing Sheets

SLOTTED CABLE GUIDE

BACKGROUND OF THE INVENTION

This invention relates to a guide for directing the prepared end of a coaxial cable into the tubular post of an end connector.

The guide of the present invention is ideally suited for guiding the prepared end of a coaxial cable into the post of a compression type end connector. The coaxial cable comprises a center conductor surrounded by a dielectric layer which is covered by a metal sheath and an outer protective jacket. A compression type end connector is described in further detail in U.S. Pat. No. 5,470,257, wherein a hollow post is contained within the body of the end connector and is surrounded by a collapsible ring which extends the length of the connector. The extended length makes proper insertion of the center conductor of the cable into the post difficult and awkward and can result in the cable and the post becoming misaligned or damaged.

A guide for aiding in the insertion of the prepared end of a coaxial cable into the tubular post of an end connector is disclosed in U.S. Pat. No. 6,352,448 to Holliday and Wong. The guide has an elongated cylindrical body and contains a circular bore that passes axially through the body. The exposed center conductor at the prepared end of a coaxial cable is inserted into the circular bore of the guide and the leading edge of the guide is inserted into the hollow post. The guide is dimensional so that the center conductor and the inner dielectric layer surrounding the center conductor will pass into the hollow post, while the wire mesh layer that surrounds the dielectric layer and the outer barrier layer of the cable pass over the outer surface of the post. As can be seen, to obtain this close alignment between the guide and the post, tight tolerances must be maintained between the outer diameter of the guide and the interior of the post. In the event the guide becomes slightly out of line or out of tolerance, the cylindrical guide will bind, or even plug, against the cylindrical inner wall of the post as the guide is passing through the post. This can cause damage to the cable and the post during the extraction process.

SUMMARY OF THE INVENTION

It is a primary object of the present invention to improve guides for inserting the prepared end of a coaxial cable into a cylindrical post of an end connector.

It is a further object of the present invention to reduce the contact area of a guide that is used to insert the prepared end of a coaxial cable into a cylindrical post of a compression type end connector.

Another object of the present invention is to provide a guide for inserting the prepared end of a coaxial cable into the post of an end connector that can be easily collapsed to gain easy entry of the guide into the post, yet have sufficient resiliency to support the cable centered in the post when the collapsing force is released.

Another object of the present invention is to prevent the inner dielectric layer and center connector at the prepared end of a coaxial cable from being damaged as the prepared end of the cable is being inserted into the post of an end connector.

These and other objects of the present invention are attained by a guide for directing the prepared end of a coaxial cable into a cylindrical post of an end connector. The guide contains a plurality of planar walls that come together to form a series of corners equal in number to the number of walls with the angles subtended by each corner being equal. The bisectors of the corners cross at the central axis of the guide with the length of each bisector from the axis to the corner being about equal to or slightly greater than the inside radius of the post. The guide contains an axially extended slit that provides a passage that opens into a centrally located slot.

BRIEF DESCRIPTION OF THE DRAWINGS

For a better understanding of these and other objects of the invention, reference will be made to the following detailed description of the invention, which is to be made in association with the accompanying drawings, wherein.

DETAILED DESCRIPTION OF THE INVENTION

Figure 1:
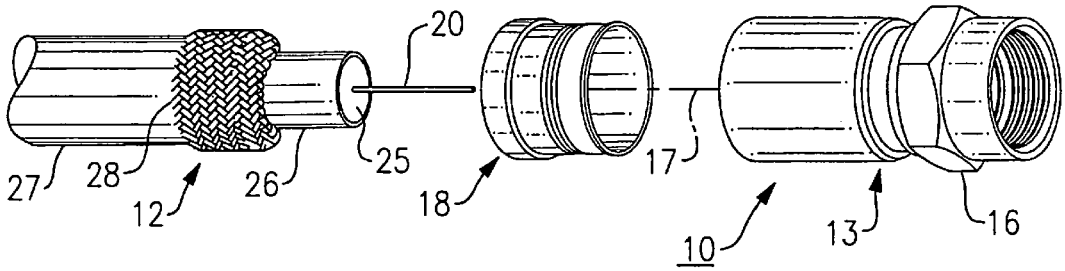
FIG. 1 is an exploded view showing the prepared end of a coaxial cable and a compression type end connector prior to the end connector being joined to the prepared end of the cable.

Referring initially to FIGS. 1-4, there is illustrated a coaxial cable connector 10 for receiving the prepared end of a coaxial cable 12 therein so that the coaxial cable can be accurately joined to the end connector. The cable connector includes a connector body 13 that contains a hollow, cylindrical post 15. An internally threaded nut 16 is rotatably secured to the extended end of the post. The post and the body of the end connector are both coaxially aligned along the central axis 17 of the end connector. A compression ring 18 is passed into the back end of the body. The internal surface of the compression ring has an inclined section 19 (FIG. 2) that is arranged to ride in contact against the outside surface of the coaxial cable.

As illustrated in FIG. 1, one end of the coaxial cable 12 is prepared by stripping away part of the outer protective jacket 27 from the end face of the inner dielectric layer 25. The wire mesh cover 28 that separates the outer protective jacket 27 from the inner dielectric layer is passed back over the protective jacket.

The outer diameter of the inner dielectric layer is about equal to the inside diameter of the end connector post so that the inner dielectric layer can be slidably received within the post. As the cable moves into the post, the external surface of the post passes between the wire mesh layer and the inner dielectric layer of the coaxial cable. Proper insertion of the prepared cable in the converter results in the center conductor being centrally positioned inside the threaded nut of the end connector. With the center connector properly positioned within the nut, an axially-directed force is applied to the compression ring to drive the inclined section of the ring into the post. This, in turn, compresses the outer protective jacket of the coaxial cable downwardly in a radial direction into frictional engagement with the post thus joining the cable to the end connector with the center conductor 20 in axial alignment with the central axis 17 of the end connector.

Over time, and particularly with the advent of compression type end connectors, the end connectors have increased considerably in length. As a consequence, the receiving end of the connector post is typically well hidden inside the body of the connector making accurate insertion of the prepared end of the coaxial cable difficult. As noted above, misalignment of the cable during insertion can lead to the center conductor becoming bent or even broken and the inner dielectric layer of the cable becoming damaged. A solution to this problem is the use of elongated cylindrical guides to help locate the prepared end of a coaxial cable within the post of a coaxial connector. These efforts have met with only limited success.

The prior art shows the use of a loose fitting cylindrical guides fitted within the post (U.S. Pat. No. 6,352,448). Attempting to pass a close fitting cylindrical guide through a tubular post can pose problems particularly as the depth of penetration of the guide lengthens. Any slight variations in the clearance between the two mated parts can cause the guide to become misaligned or even plugged within the post. The prior art cylindrical guides generally have an oversized axially disposed bore that passes inwardly through one of the guide end faces for housing the exposed center conductor of the cable that is being guided into the post. This loose fitting arrangement results in the center conductor of the cable not being well supported whereupon the center conductor can be bent as the guide is maneuvered through the post.

Figure 2:
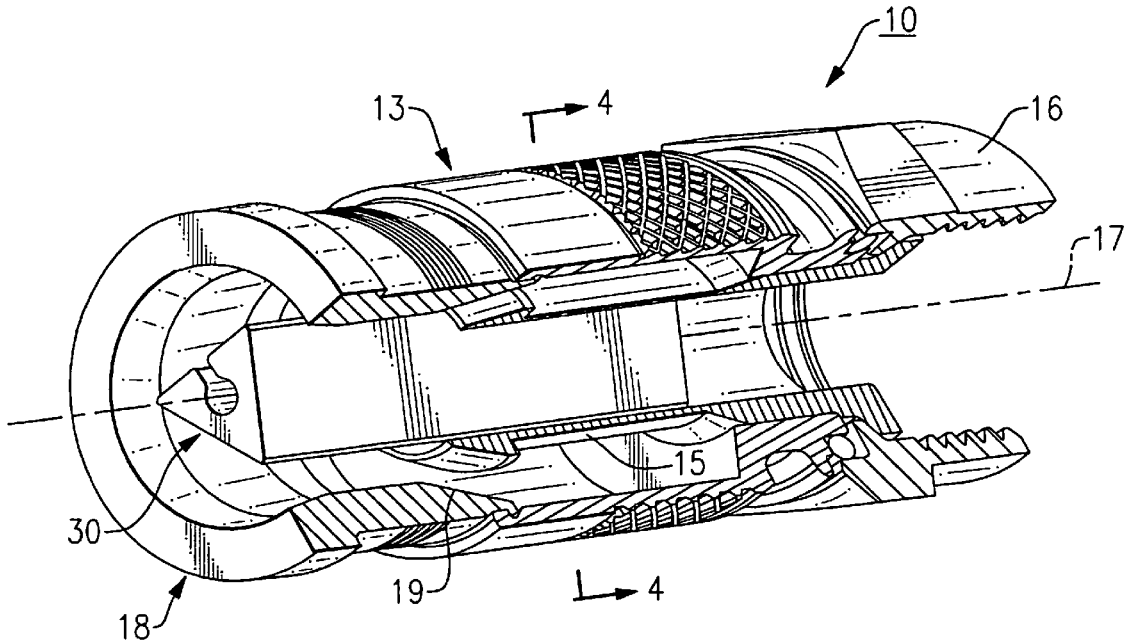
FIG. 2 is a perspective view illustrating the end connector assembly with a guide for locating the prepared end of a cable partially inserted within the assembly.
Figure 3:
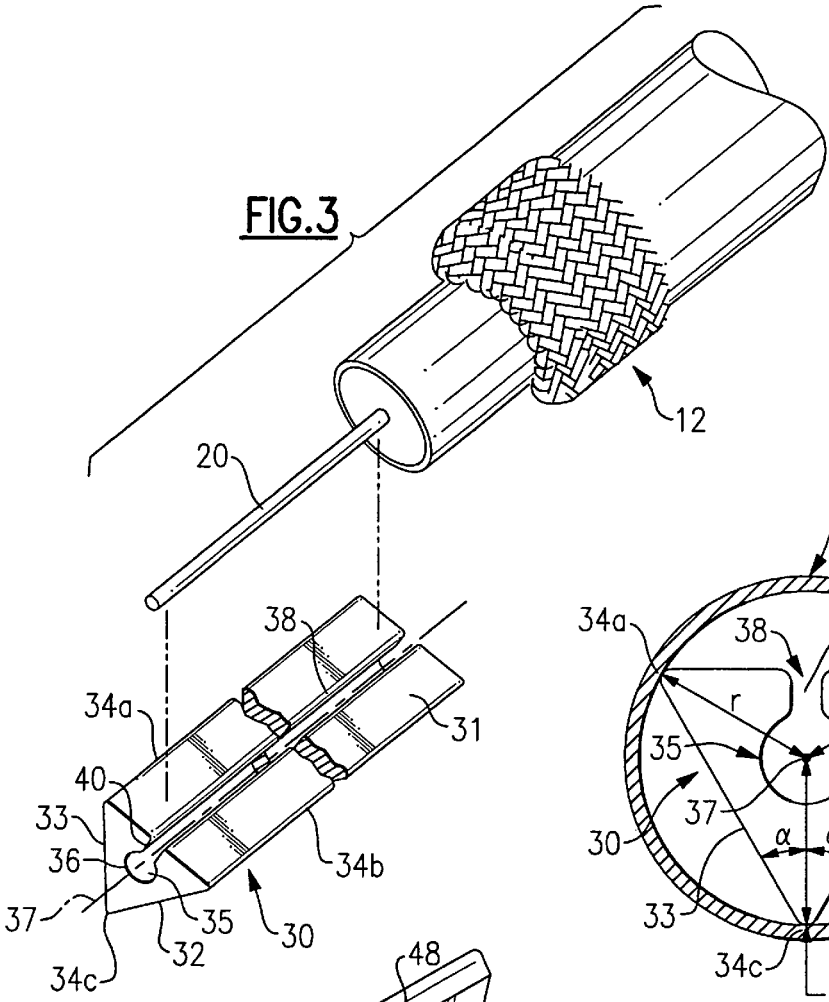
FIG. 3 is a perspective view illustrating a first embodiment of the invention showing the prepared end of a coaxial cable radially entering the guide.
Figure 4:
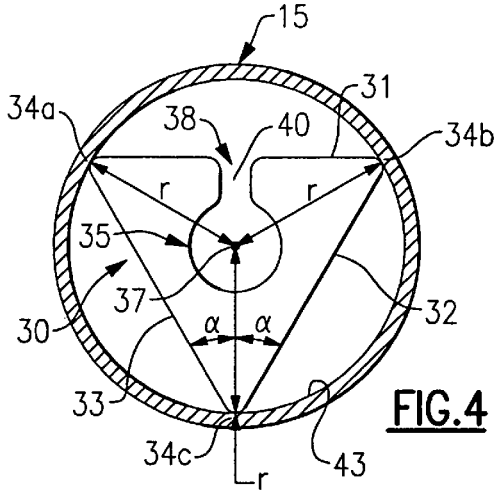
FIG. 4 is an enlarged sectional view taken along lines 44 in FIG. 2 showing a guide positioned within the post of the end connector.

As illustrated in FIGS. 2-4, in one embodiment of the invention, the guide 30 is an elongated triangular-shaped member that has sides 31-33 that come together to form three corners 34*a*, 34*b*, 34*c*. A slot, generally referenced 35, extends axially along the length of the guide body. The guide includes a slit that passes inwardly through one of the side walls 31 of the guide and passes into the slot through entrance 40. The slit 38 provides a side access passage for the center conductor of the coaxial cable to slot 35. The throat width of the entrance is slightly less than the diameter of the center conductor 20 of the coaxial cable, the reason for which will be made clear from the disclosure below.

Preferably, the guide is extruded from a resilient material such as plastic, rubber, or any suitable elastomeric material or the like. Sufficient resilience is provided to the guide body so that the center conductor of the cable can be passed radially through the slit 38 as illustrated in FIG. 3 and snap fitted into the slot through the entrance throat 40. The slot in this embodiment is circular and has a diameter wherein the center connector of the cable is in a tight frictional fit in the slot once the center connector has been snap fitted into the slot. The slot of the guide may take a variety of shapes such as square, rectangular, oval, or trapezoidal, so long as the center conductor is supported snuggly within the passage once the center conductor is snap fitted in place through the entrance of the slit 38.

Turning now to FIG. 4, the triangular-shaped guide 30 has three contact surfaces or points 34*a*, 34*b*, 34*c* that are arranged to ride in sliding contact against the inner wall surface 43 of the post 15 of the end connector. To gain entry into the post, the resilient guide is compressed to close the slit prior to insertion into the post. Once inserted, the compressing force is released and the corners of the guide move back into biasing contact against the inside wall surface of the post. This three point contact is sufficient to hold the guide centered in the post while minimizing the amount of friction that can be generated between the mating parts. Accordingly, the guide can be easily passed in sliding contact through the post.

In practice, the cable is brought to a desired position inside the post and the cable is then restrained from further movement while the guide is passed completely through the post clear of the end connector.

Figure 5:
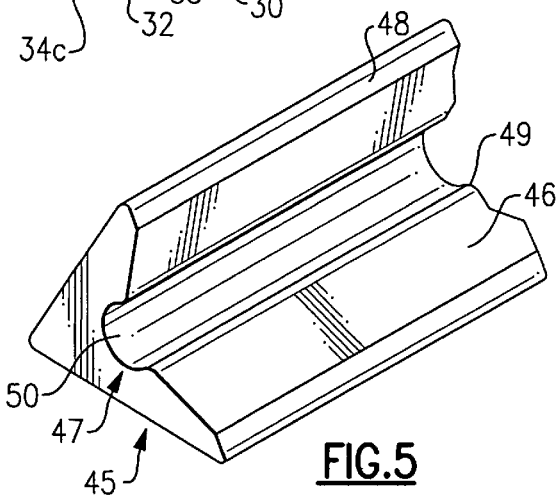
FIG. 5 is a perspective view illustrating a second embodiment of the invention.

FIG. 5 illustrates a further embodiment of the invention wherein the body of the guide 45 is again triangular-shaped. The slit 46 diverges from a wide opening at side wall 48 to entrance 49 of the central slot 50.

Figure 6:
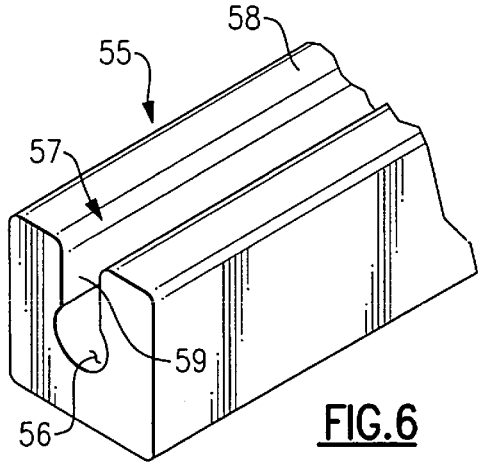
FIG. 6 is a perspective view illustrating a third embodiment of the invention.

FIG. 6 illustrates a guide 55 that has a substantially square cross-section. The guide further contains a slot 56 that is aligned along the center axis of the guide. A longitudinal slit 57 passes from the exterior surface 58 of the guide and opens into the central slot 56 through entrance 59. Here again, the center conductor of the coaxial cable 20 can be snap fitted into the central passage through the slit 57. In this embodiment of the invention, the guide has four corners that are arranged to ride in sliding contact with the interior surface of the connector post.

Figure 7:
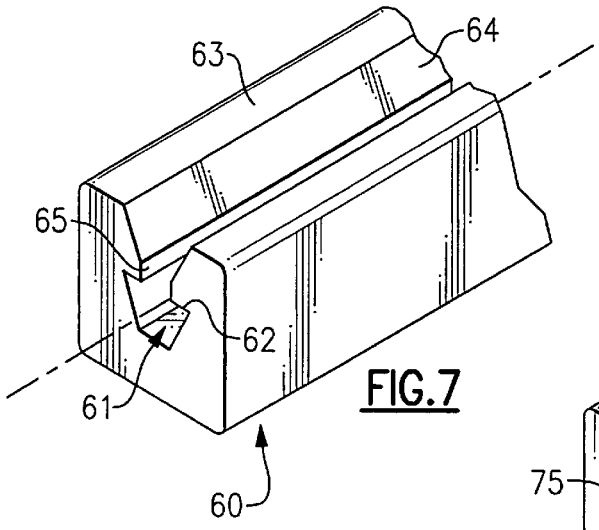
FIG. 7 is a perspective view illustrating a fourth embodiment of the invention.

The elongated guide 60 as shown in FIG. 7 contains a trapezoidal-shaped center slot 61. A diverging slit 64 beginning at the exterior surface of the guide passes into the central passage through an entrance 65.

Figure 8:
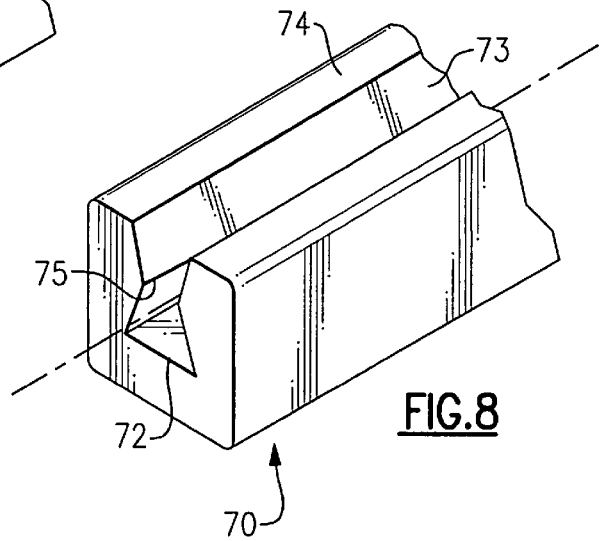
FIG. 8 is a perspective view illustrating a fifth embodiment of the invention.

The embodiment illustrated in FIG. 8 slot has a body 71, which contains a triangular-shaped central slot 72. A diverging slit 73 which is centered upon the apex of the triangle begins at the exterior surface 74 of the guide and opens into the slot through an entrance 75.

Figure 9:
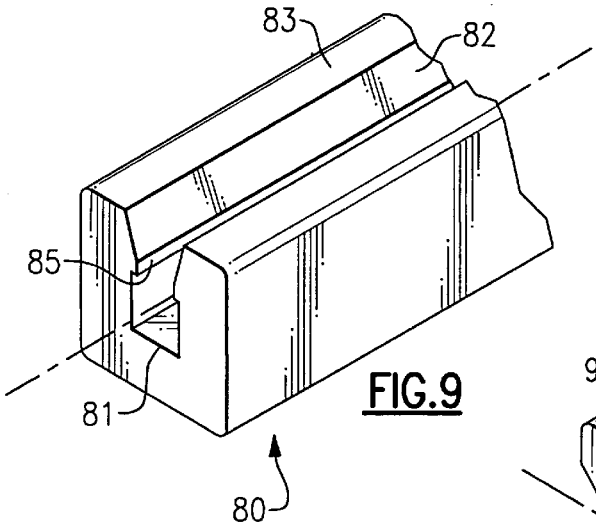
FIG. 9 is a perspective view illustrating a sixth embodiment of the invention.

FIG. 9 further illustrates a guide 80 having a square-shaped central slot 81. A diverging slit 82 passes downwardly from the exterior surface 83 and opens into the central slot 71 through an entrance 85.

Figure 10:
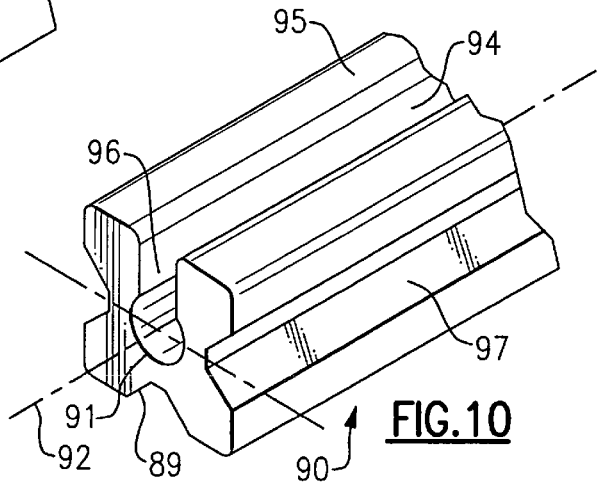
FIG. 10 is a perspective view illustrating a seventh embodiment of the invention.

The guide 90 that is illustrated in FIG. 10 has an oval-shaped central slot 81 that is axially aligned along the central axis 92 of the guide. A slit 94 extends downward from the exterior surface 95 of the guide and opens into the central slot through an entrance 96. The remaining walls of the guide each contain V-shaped groove 97 that extends inwardly from the outer surface of each wall to a given depth. The V-shaped grooves in the walls of the guide provide weakened sections to the guide that serve to permit the guide to be easily compressed in a number of different directions as it passes through the post of the end connector.

Figure 11:
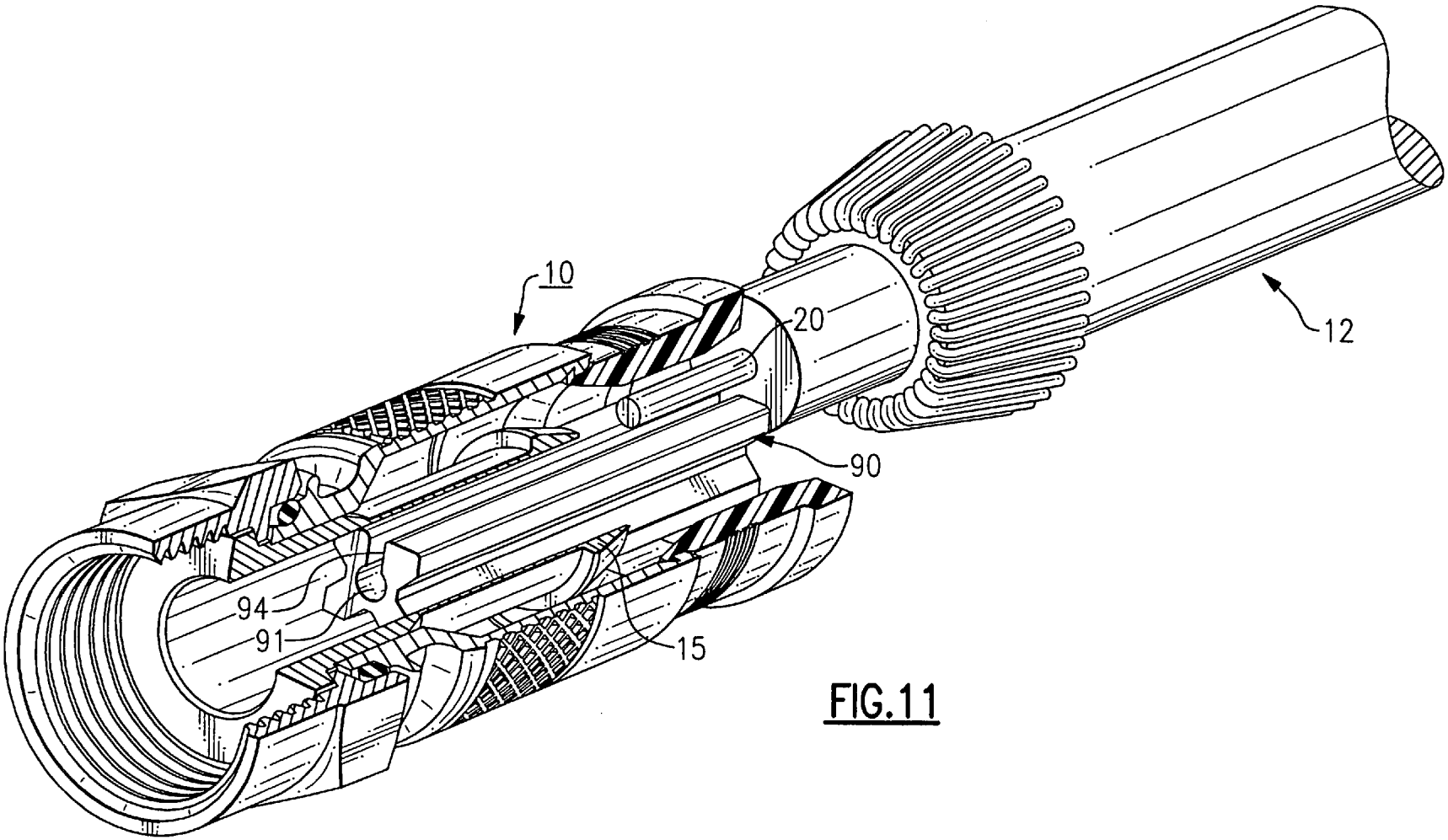
FIGS. 11 and 12 further illustrate the manner in which the prepared end of a coaxial cable is mounted within the guide.
Figure 12:
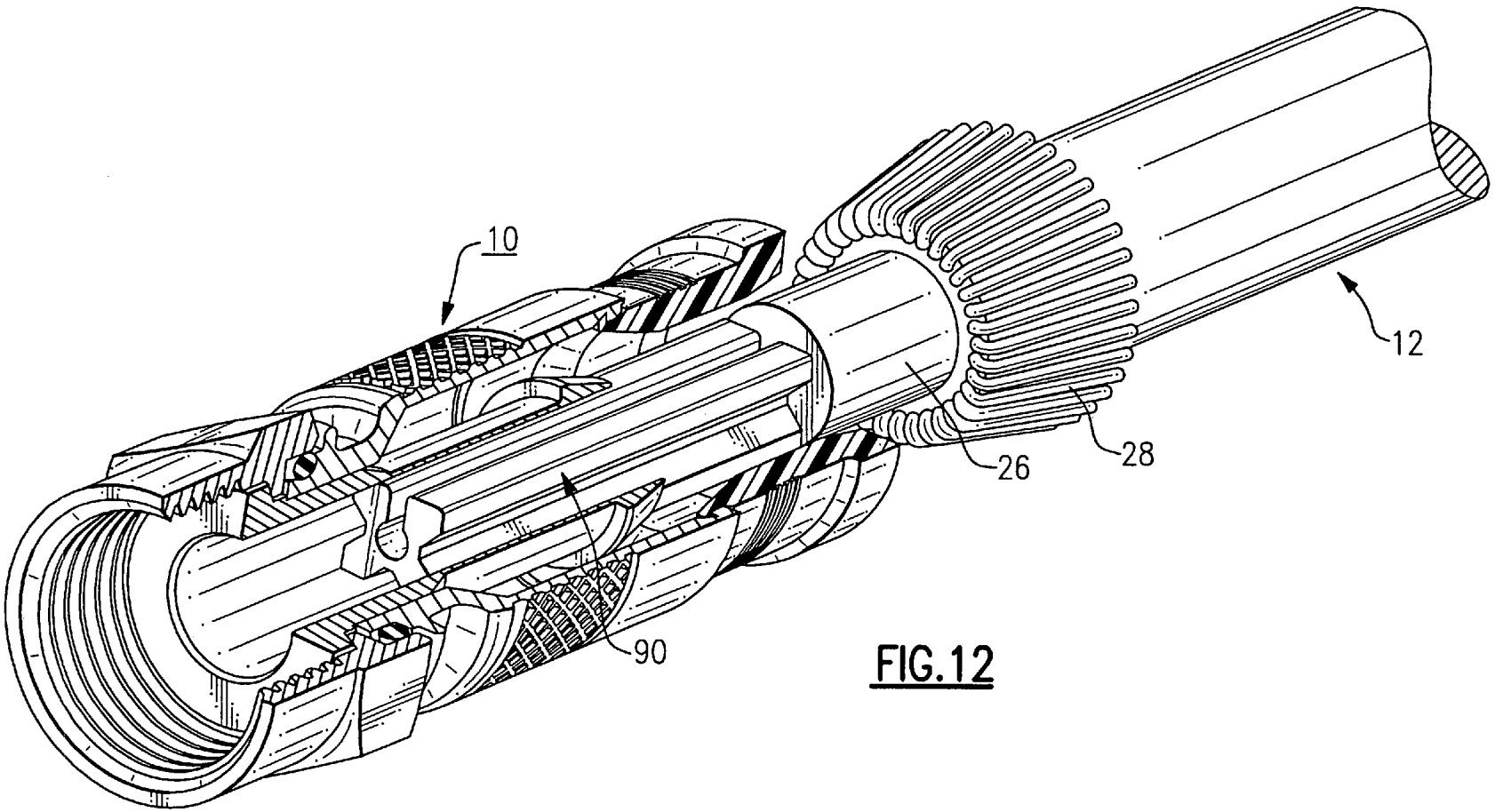

FIGS. 11 and 12 show the manner in which the guide shown in FIG. 10 is used with the prepared end of a coaxial cable 10. The guide 90 is inserted into post 15. The center conductor 20 of cable in one form can be brought into contact with slit 94 and easily moved through the slit to engage the central slot 91. Once engaged as depicted in FIG. 12, the cable can be advanced into the connector with the center conductor being properly guided and aligned so that the post engages the cable between the dielectric layer 26 and the wire mesh 28.

While this invention has been particularly shown and described with reference to the preferred embodiment in the drawings, it will be understood by one skilled in the art that various changes in its details may be effected therein without departing from the teachings of the invention.

What is claimed is:

1. A guide for inserting the prepared end of a coaxial cable into centered relation with a cylindrical post of a coaxial cable connector, the prepared end of the coaxial cable having a center conductor extending from the end face of an inner dielectrical layer, a wire mesh covering the inner dielectric layer and having an outer protective jacket, the wire mesh set back from the end face of the inner dielectric layer and being rolled back over the protective jacket, wherein said guide includes: an elongated member made of a resilient material, said elongated member having an exterior surface and having an internal axially extending slot; said elongated member having at least three axially disposed contact surfaces on the exterior surface; and said elongated member further having a slit passing radially from the exterior surface to the slot to form an entrance into the slot, whereby the center conductor can be moved through the slit into engagement with the slot and whereby as the prepared end of the coaxial cable is advanced into the connector the guide is slidingly passed through the cylindrical post.

2. The guide of claim 1 wherein said slot has a width across the entrance that is less than the diameter of the center conductor whereby the center conductor can be snap fitted into the slot through the slit entrance.

3. The guide of claim 1 wherein said elongated member contains a plurality of flat sides that come together at equal angles to form said contact surfaces.

4. The guide of claim 3 wherein bisectors of the corner angles all cross at the central axis of said elongated member.

5. The guide of claim 4, wherein the length of each bisector as measured from the central axis of said member to a corner is about equal to the inside radius of the post of the end connector.

6. The guide of claim 4, wherein the length of each bisector measured from the center axis to a corner is slightly greater than the inside radius of the end connector post whereby the member is compressed as the member moves into said post.

7. The guide of claim 1, wherein said slit is centered upon one side wall of the member.

8. The guide of claim 7, wherein said slit diverges from the outer surface of said one side wall toward the entrance to said slot.

9. The guide of claim 1, wherein said slot has a circular cross-section.

10. The guide of claim 1, wherein said slot has a rectangular cross-section.

11. The guide of claim 1, wherein said slot has an oval cross-section.

12. The guide of claim 1, wherein said elongated member has a triangular cross-section.

13. The guide of claim 1, wherein said elongated member has a square cross-section.

14. The guide of claim 1, wherein said elongated member is fabricated of an elastomeric material.

15. A guide for inserting the prepared end of coaxial cable into centered relation with a cylindrical post of a coaxial cable end connector, said prepared end of the cable containing a center conductor extending from the end face of an inner dielectric layer, a wire mesh covering the inner dielectric layer and having an outer protective jacket, the wire mesh being set back from the end face of the inner dielectric layer and rolled back over the protective jacket, wherein said guide includes: an elongated member fabricated of a resilient material and having a central slot that extends axially through said member; said elongated member further includes a plurality of flat side walls that come together at equal angles to form corners that are arranged to ride in sliding contact against the inside wall surface of said post to compress the elongated member as it moves through said post; and said elongated member further including a slit that passes radially through one of said side walls to form an entrance that opens into said slot, said entrance having a width that is less than the diameter of the center conductor.

16. The guide of claim 15, wherein said slot has a circular cross-section.

17. The guide of claim 15, wherein said slot has a rectangular cross-section.

18. The guide of claim 15, wherein said member is fabricated from a material selected from a group of materials consisting of elastomers, rubbers, and plastics.

19. The guide of claim 15, wherein said slit diverges inwardly from the outer surface of said elongated member toward said entrance to said slot.

20. The guide of claim 15, wherein at least one of said side walls has a weakened section.

21. The guide of claim 15, wherein said weakened section is located at the midsection of said one wall.

22. The guide of claim 15, wherein each of said walls has a weakened section.

* * * * *

UNITED STATES PATENT AND TRADEMARK OFFICE
Certificate

Patent No. 7,299,549 B2 Patented: November 27, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Noah Montena, Syracuse, NY (US); and Stephen Malak, Sarasota, FL (US).

Signed and Sealed this Thirtieth Day of August 2011.

DERRIS H. BANKS
*Supervisory Patent Examiner*
Art Unit 3729
Technology Center 3700